US007699766B2

(12) United States Patent
Ellsworth et al.

(10) Patent No.: US 7,699,766 B2
(45) Date of Patent: Apr. 20, 2010

(54) DECANTING CENTRIFUGE WITH VIBRATION ISOLATION

(75) Inventors: James R. Ellsworth, Marshfield, MA (US); Paul McGovern, Hanson, MA (US)

(73) Assignee: Harvest Technologies Corporation, Plymouth, MA (US)

( * ) Notice: Subject to any disclaimer, the term of this patent is extended or adjusted under 35 U.S.C. 154(b) by 0 days.

(21) Appl. No.: 11/707,142

(22) Filed: Feb. 16, 2007

(65) Prior Publication Data

US 2007/0142196 A1 Jun. 21, 2007

Related U.S. Application Data

(63) Continuation of application No. 10/629,825, filed on Jul. 30, 2003, now abandoned.

(60) Provisional application No. 60/400,072, filed on Aug. 2, 2002.

(51) Int. Cl.
*B04B 5/02* (2006.01)
*B04B 9/14* (2006.01)

(52) U.S. Cl. ..... 494/20; 494/82

(58) Field of Classification Search ..... 494/16, 494/20, 21, 31, 33, 43, 82; 210/144
See application file for complete search history.

(56) References Cited

U.S. PATENT DOCUMENTS 3,322,338 A * 5/1967 Woodall et al. ..... 494/9
3,366,318 A 1/1968 Steimel
3,401,876 A * 9/1968 Grifols ..... 494/16
3,606,143 A * 9/1971 Stallmann ..... 494/39
3,722,789 A 3/1973 Kennedy
3,860,165 A 1/1975 Fiedler
3,951,334 A 4/1976 Fleming et al.
4,010,893 A * 3/1977 Smith et al. ..... 494/1
4,079,882 A 3/1978 Mizuyoshi et al.
4,099,667 A 7/1978 Uchida
4,221,325 A 9/1980 Kubota
4,431,423 A 2/1984 Weyant, Jr.
4,435,169 A 3/1984 Romanauskas
4,537,382 A 8/1985 Beck
4,690,669 A 9/1987 Williams et al.
4,910,502 A 3/1990 Serveau et al.
4,981,585 A * 1/1991 Kelley et al. ..... 210/138
5,045,047 A * 9/1991 Hutchins et al. ..... 494/17

(Continued)

FOREIGN PATENT DOCUMENTS

JP 61-102253 5/1986

(Continued)

*Primary Examiner*—Charles E Cooley
(74) *Attorney, Agent, or Firm*—Clark & Bordy

(57) ABSTRACT

A centrifuge has a rotor for receiving a disposable processing unit. The centrifuge is configured such that the motor is attached to an enclosure and the enclosure is supported on a base. The connection between the base and the enclosure is a vibration isolator, and the isolator is positioned such that its effective line of action aligns with the effective plane of rotation of the rotor. In accordance with another feature of the invention, the processing units are held in a decanting position by a decant ring that moves vertically but does not rotate. The ring engages the top of the processing unit during decant and the abrasion is minimal.

7 Claims, 3 Drawing Sheets

U.S. PATENT DOCUMENTS

| | | | | |
|---|---|---|---|---|
| 5,047,004 | A * | 9/1991 | Wells | 494/17 |
| 5,178,602 | A * | 1/1993 | Wells | 494/17 |
| 5,387,174 | A | 2/1995 | Rochat | |
| 5,707,331 | A | 1/1998 | Wells et al. | |
| 5,767,381 | A | 6/1998 | Konno et al. | |
| 5,851,170 | A | 12/1998 | Howell | |
| 6,132,354 | A * | 10/2000 | Ohtsu et al. | 494/16 |
| 6,234,948 | B1 | 5/2001 | Yavilevich | |
| 6,338,708 | B1 * | 1/2002 | Miura et al. | 494/82 |
| 6,354,988 | B1 * | 3/2002 | Carson et al. | 494/82 |
| RE38,757 | E * | 7/2005 | Wells et al. | 494/20 |
| 6,953,424 | B2 * | 10/2005 | Kusumoto et al. | 494/10 |
| 6,960,158 | B2 * | 11/2005 | Mackel | 494/82 |
| 2004/0071569 | A1 * | 4/2004 | Ellsworth et al. | |
| 2007/0142196 | A1 * | 6/2007 | Ellsworth et al. | |

FOREIGN PATENT DOCUMENTS

| | | | |
|---|---|---|---|
| JP | 62-236593 | | 10/1987 |
| JP | 14-012360 | | 11/1987 |
| JP | 08126923 | A * | 5/1996 |
| JP | 2000-176268 | | 6/2000 |
| JP | 2002-248379 | | 6/2000 |
| JP | 2000176268 | A * | 6/2000 |
| JP | 2002248379 | A * | 9/2002 |
| WO | 01/08807 | A1 * | 2/2001 |
| WO | 2004/012868 | A1 | 2/2004 |
| WO | WO 2004012868 | A1 * | 2/2004 |

* cited by examiner

DECANTING CENTRIFUGE WITH VIBRATION ISOLATION

CROSS REFERENCE TO RELATED APPLICATIONS

This is a continuation of U.S. patent application Ser. No. 10/629,825 filed Jul. 30, 2003 (now abandoned), which claims the benefit under 35 U.S.C. §119(e) of U.S. Provisional Application No. 60/400,072 filed on Aug. 2, 2002.

TECHNICAL FIELD

This invention relates to the art of centrifuges. In particular this invention relates to the art of decanting centrifuges with disposable liquid containers and to centrifuges with vibration isolation.

BACKGROUND

U.S. Pat. No. 5,707,331 (Wells) discloses a decanting centrifuge for separating through centrifugation two or more components of blood. The Wells patent teaches the use of a removable, disposable processing unit that has two fluid chambers. The processing unit is received in a centrifuge apparatus that can hold the processing unit selectively in particular orientations whereby supernatant fluids can be transferred from one chamber to another by way of gravity draining or centrifugal transfer.

The Wells patent does not describe structure for limiting vibrations of the centrifuge arising from imbalances in the rotor, and the Wells centrifuge is, accordingly susceptible to such vibrations. Imbalance in the Wells system typically occurs when the volume of blood placed in the processing unit is greater or less than the design volume. For example, a typical centrifuge according to the Wells system may be designed to process 50 ml of blood, whereas the user may actually place 20 ml to 60 ml in the processing unit. Such a differential in the amount of blood is significant, and forces caused by this imbalance arise during centrifugation.

While vibration-isolating structures are known, they are placed in the centrifuge such that absorption of the imbalance forces creates torque on the rotor shaft, which must then be absorbed also. Thus, an inexpensive and efficient structure for absorbing imbalance forces is desirable.

The Wells patent also describes structure for holding the processing unit in a desired orientation. In the disclosed embodiment, a movable plate is designed to engage a part of a support frame that supports the processing disposable. That plate is electrically or magnetically driven between two vertical positions. In the lowered position, the plate does not contact the support frame, and the processing disposable swings freely during centrifugation. In a second position, the plate engage the frame to hold the processing disposable in a tilted orientation whereby supernatant in one of the chambers drains into a second of the chambers. In yet another position, the plate engages the frame to hold the processing disposable in an orientation whereby supernatant is centrifugally transferred from one chamber to another.

The movable plate in the Wells patent rotates with the rotor, and there is no relative movement in the circumferential direction between the plate and the support frame. This prevents wear of the support frame or the plate that would result from such relative motions but, at the same time, requires more complex structure to control the vertical positions of the rotating plate. Reducing the complexity of this structure is desirable.

Accordingly, there is a need for a centrifuge that relies upon less expensive structures and reduces vibrations.

SUMMARY OF THE INVENTION

In accordance with one feature of the invention, a centrifuge provides vibration-isolating elements that resist the forces arising from imbalance in a centrifuge rotor. The vibration-isolating elements are placed with respect to the rotor such that the force-absorbing parts of the elements align directly with the forces created by the imbalanced rotor. Because there is no distance separating the imbalance forces from the counteracting forces, no torque is generated, as is the case in the prior art. This eliminates the necessity of counteracting the torque also and simplifies the construction.

In the preferred embodiment, the vibration isolating elements are aligned with the rotor by providing an enclosure on which are mounted the rotor and driving motor and by supporting the enclosure on a base with the vibration-isolating elements. The vibration-isolating elements may be of various constructions, but the preferred construction is to provide an elastic element, such as a grommet between an isolator support, which is attached to the base, and a part of the enclosure that is aligned with the rotor. Other arrangements are possible, such as by providing another anchor for resiliently attaching a location on the enclosure aligned with the rotor to a support element.

In accordance with another feature of the invention, a movable decant ring is positioned to move vertically between one position wherein it does not engage the processing unit and the processing unit is free to swing during centrifugation and a second position where the ring engages the processing unit to hold it an a position that allows a supernatant in one chamber to flow to a second chamber. The decant ring is movable vertically but does not move circumferentially, in the direction of rotation of the rotor. This simplifies the structure of the movable ring and its driving elements. In the preferred embodiment, the ring is moved upward, into a position of engagement with the processing unit, by three electric solenoids. The advantage of electric solenoids is that they are easily obtained and easily controlled. It will be appreciate, however, that other driving elements may be used and that there may be more or fewer elements.

DETAILED DESCRIPTION OF THE PREFERRED EMBODIMENT

Figure 1:
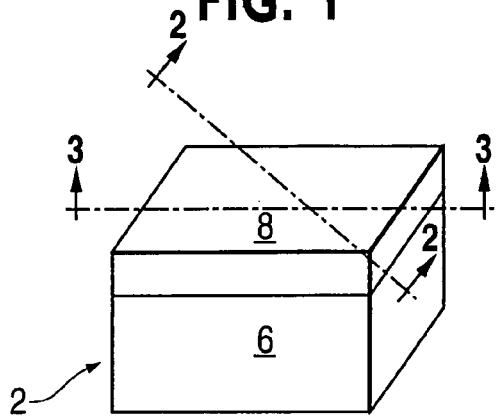
FIG. 1 is a perspective view of the exterior of a centrifuge in accordance with the invention.

With reference to FIG. 1, a centrifuge 2 includes a base element 4 (see FIGS. 2 and 3) and an enclosure 6. The centrifuge can be any of various shapes and is generally designed to rest on a horizontal support surface, such as the floor, a table in a doctor's office or a surgical suite or on a dolly that is easily moved from one location to another. An enclosure 6 is supported on the base 4 in a manner to be described below and is configured to enclose the movable parts and particularly to provide a cavity for a centrifuge rotor and fluid processing units as will be described below. A lid 8 is provided to cooperate with the enclosure to cover the cavity when the centrifuge is in use so that the spinning rotor is protected. The lid 8 in preferably attached to the enclosure by hinges that allow the lid to be raised and the cavity exposed. As well, the lid may include safety elements that prevent raising or removing the lid during operation of the system, which would expose a moving centrifuge rotor.

Figure 2:
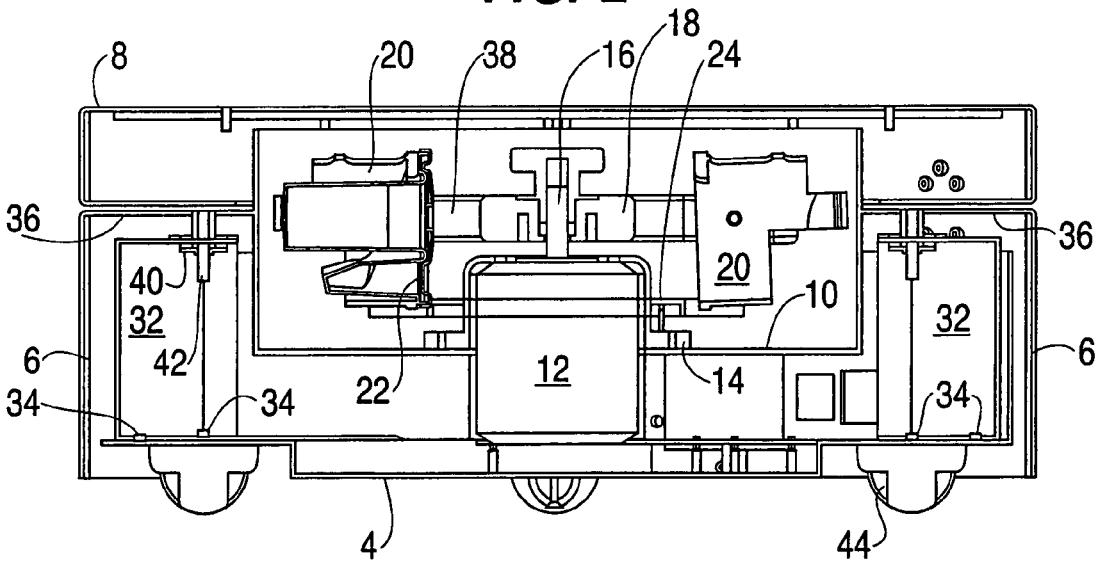
FIG. 2 is a vertical cross section of the centrifuge of FIG. 1 taken along line 2-2 of FIG. 1.
Figure 3:
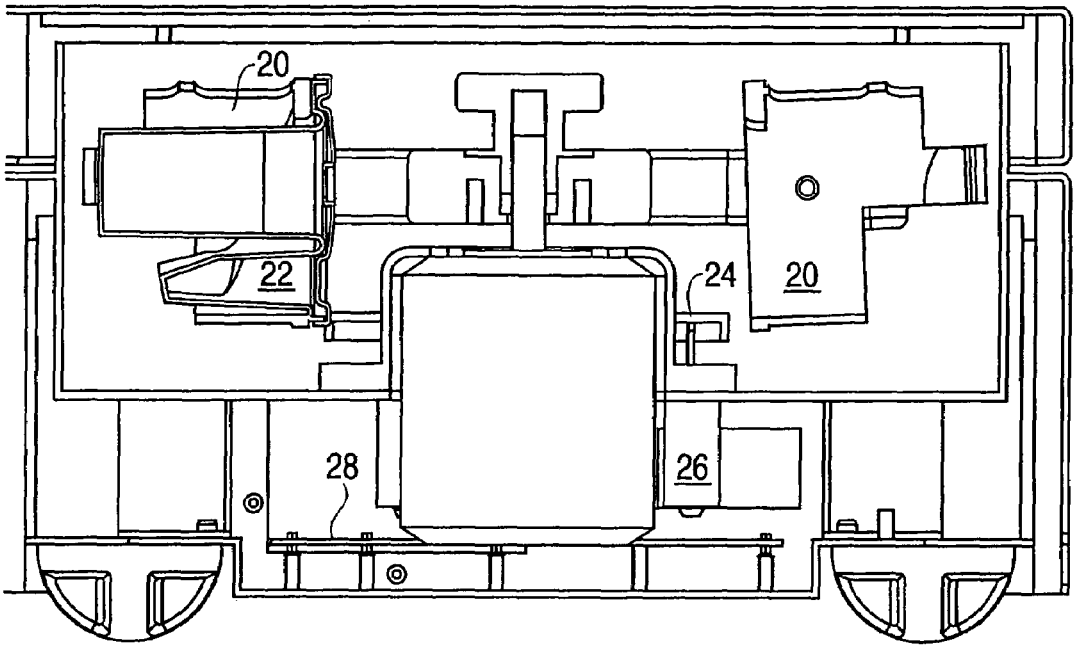
FIG. 3 is a vertical cross section of the centrifuge of FIG. 1 taken along line 3-3.
Figure 4:
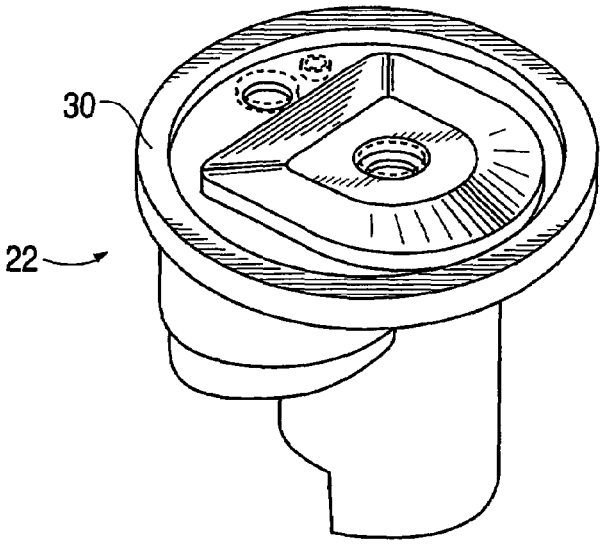
FIG. 4 is a perspective view of a preferred processing unit.
Figure 5:
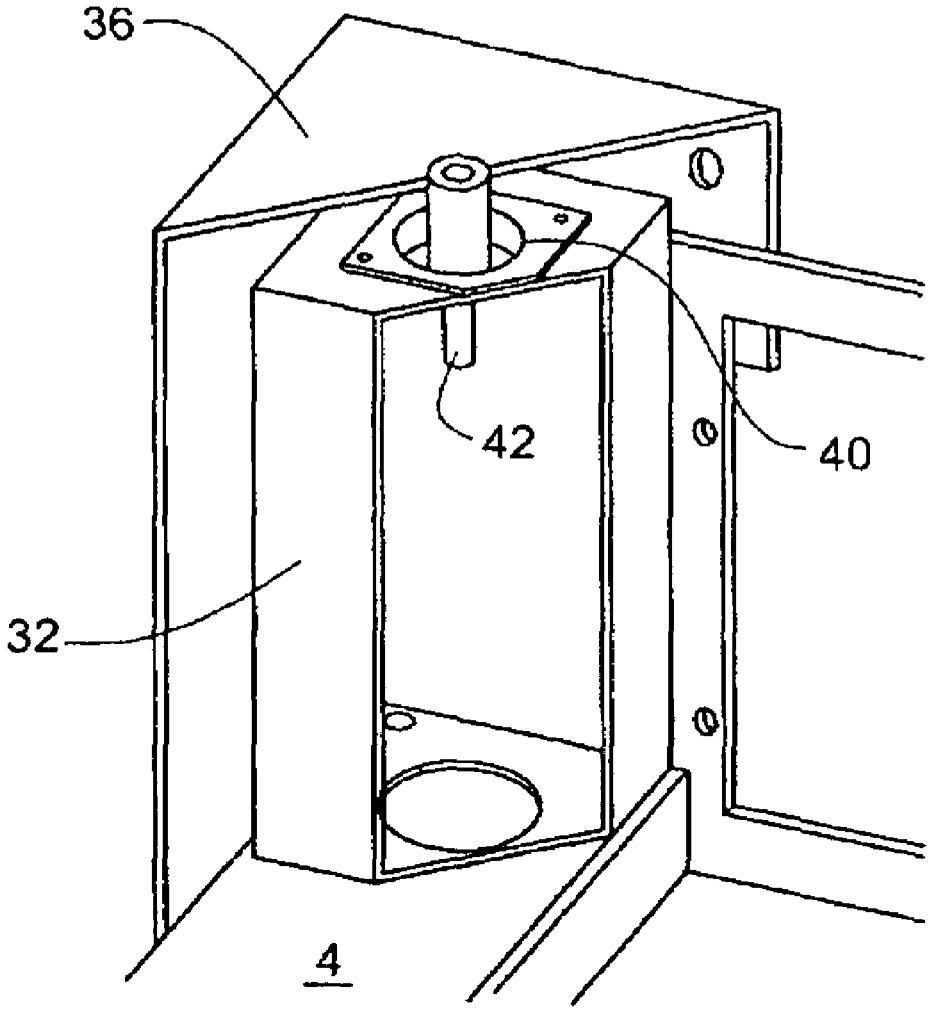
FIG. 5 is a cut-away, enlarged view of a portion of FIG. 2.

The enclosure 6 includes a central portion 10 that provides a location for mounting a motor 12 above the base 4 as seen in FIGS. 2 and 3. The motor 12 includes flanges 14 that engage the central portion for supporting the motor. The motor includes a shaft 16 that, in turn, has mounted thereon a rotor 18. The rotor has one or more support frames 20, which are pivotally mounted to outer portions of the rotor. Each of the frames is configured to receive a processing disposable unit (see FIG. 4), which is removably received in the frame. The processing disposable unit includes two or more chambers, and preferably two. One of the chambers is designed to receive blood from a patient, and the other is designed to receive a supernatant after initial centrifugation. The supernatant is transferred to the second chamber by holding the processing unit in an orientation that allows the supernatant to drain into the second chamber in a manner similar to that described in the Wells patent.

During centrifugation, the frame 20 and processing unit 22 naturally swing by centrifugal forces to the orientation shown in FIGS. 2 and 3. During centrifugation, red blood cells are separated from supernatant plasma, but the fluids remain in the first chamber of the processing unit by centrifugal forces. As explained in the Wells patent, supernatant can be transferred from the first chamber to the second by holding the processing unit in the orientation shown, or almost that, and slowing the rate of rotation of the rotor.

In the embodiment shown, a decant ring 24 is provided to hold the processing unit in the desired orientation to allow the supernatant to drain. The decant ring 24 is positioned such that it lies in a lowered position in the beginning and end of a centrifugation cycle. In the lowered position, the decant ring does not constrain the processing unit 22 to any particular orientation. The decant ring 24 can be moved vertically when desired, however, such that the ring engages the processing unit to hold it in a desired orientation. In the preferred embodiment shown, the decant ring is circular and is concentric with the motor 12 so that it surrounds a portion of the motor. The decant ring is preferably supported by electrically operated solenoids 26 (see FIG. 3) but could be supported in other ways that can be controlled electronically even though purely mechanical devices may be useful. As well, fewer but larger magnetic elements could be used. Preferably, three such solenoids are evenly spaced about the motor to support the decant ring 24. When the solenoids are operated by commands from an electronic control board 28, the central cores of the solenoids drive the decant ring upward to a position where the ring engages the processing unit to retain it in a decanting orientation. Other structures, such as a sliding or telescoping structure having an electrical or mechanical drive element may be used.

The decant ring is preferably made of a material that provides low friction with the material used for the processing unit. An acetyl plastic material sold under the trademark DELRIN has been found to be acceptable when used with moldable plastic materials. The ring is preferably solid but could be a laminate or similar manufacture.

Thus, after the rotor has achieved adequate centrifugal speed, the frame and processing unit will naturally swing outward as shown in the figures in response to centrifugal forces. When the frame and processing unit are in that position, the decant ring 24 is raised by activating solenoids 26 such that it engages the upper edge of a processing unit as the rotor slows. The decant ring, thus, holds the processing unit in the desired orientation whereby a supernatant fluid in one chamber of the processing unit flows into the other chamber by gravity.

The frame 20 is designed to hold the processing unit 22 (see FIG. 4) such that an upper edge 30 of the processing unit, or portion thereof, extends above the top of the frame 20 so that it engages the decant ring 24 when the ring is in the raised position as shown in FIGS. 2 and 3 and the rotation rate of the rotor is reduced. Thus, when the rotation rate is reduced, the frame 20 and processing unit begin to pivot toward a vertical orientation, but that pivoting motion is stopped by engagement between the decant ring 24 and the upper edge 30 of the processing unit. This allows the supernatant in one chamber of the processing unit to drain into the other chamber.

Because the rotor is still rotating when the upper edge 30 of the processing unit engages the decant ring, frictional abrasion will necessarily occur. Nevertheless, because the ring is made of a material that is harder than the material of the processing unit, the wear is made to occur on a sacrificial part of the upper edge 30. This wear is acceptable because the processing unit is disposable and used only once for each process.

In accordance with another feature of the invention, the enclosure 6 is supported on a base element 4 by isolator supports 32. The isolator supports 32 are secured to the base 4, for example, by screws 34 and extend from the base 4 to engage a portion 36 of the enclosure that is substantially aligned with the plane of rotation 38 of the rotor. By this arrangement the forces applied by the isolator supports 32 to resist forces resulting from imbalances in the rotor are aligned with each other and, therefore, cannot create a torque on the rotor shaft or motor. This reduces the strength of the various components that is required.

The plane of rotation 38 may be defined as the plane that includes the pivotal connection points for the frames 20. It will be appreciated, however, that while the plane of rotation may not be capable of precise location, the concept is that there is an effective plane of rotation through which the forces may be considered to act. Moreover, the location of that plane changes for different amounts of blood or different density characteristics (hematocrit) of the blood. Preferably the location of the plane that is most likely to occur, given the various parameters, is aligned with the effective points of resistance by the isolators. The purposes of the invention are, nevertheless, met if the vertical distance between the effective plane of rotation and the points of resistance is small. For example, in the preferred embodiment, the diameter of the rotor is eighteen inches, and the maximum vertical distance between the effective plane of rotation and the isolators is 5 mm, and more preferably 2 mm.

In the preferred embodiment, each support 32 is a hollow upstanding element made, for example, of thin metal or of plastic, and includes an isolating grommet 40 at its upper surface. A cylindrical sleeve 42 is held by the grommet. A bolt or the like is passed through the portion of the enclosure 36 to secure the enclosure to the interior part of the grommet and the bolt is received in the sleeve 42. A snubber washer is also provided to resist the forces applied by the rotor to the enclosure. The isolators are available commercially, and one supplier is the Lord Corporation, Erie, Pa. Feet 44, preferably made of resilient material support the base element on a horizontal surface.

The height of the isolator supports 32 is such that the connection between the enclosure and the grommet is substantially aligned with the plane of rotation 38 of the rotor. Thus, the frictional forces in the grommet resist the forces generated by unbalance in the rotor, and the alignment of these forces prevents generation of torque on the motor and simplifies construction.

Modifications within the scope of the appended claims will be apparent to those of skill in the art.

We claim:

1. A centrifuge comprising a base, an enclosure mounting a motor above said base, a rotor rotatably mounted on said motor, a frame mounted to said rotor at a connection point and adapted to receive a material to be centrifugally processed, said connection point moving in a plane of rotation when said rotor is rotating, a support mounted on said base, and an isolator connected to said support and to said enclosure, wherein said isolator engages said enclosure at a location that is substantially aligned with said plane of rotation.

2. A centrifuge according to claim 1 wherein said isolator comprises a resilient element.

3. A centrifuge comprising a base having feet for engaging a horizontal support surface, an enclosure mounting a motor above said base having a shaft adapted to be driven in rotation about a longitudinal axis by said motor, a rotor mounted on said shaft for rotation with said shaft about said axis, a frame pivotally mounted to said rotor at a pivotal connection point and adapted to receive a processing unit, said pivotal connection point moving in a plane of rotation when said shaft is rotating about said axis, an isolator support secured to said base, and a vibration isolator mounted between said isolator support and said enclosure, wherein said vibration isolator engages said enclosure at a location that is substantially aligned with said plane of rotation.

4. A centrifuge according to claim 3 wherein said vibration isolator comprises a resilient element that engages said enclosure.

5. A centrifuge according to claim 4 wherein said vibration isolator comprises a cylindrical sleeve held by an isolating grommet.

6. A centrifuge according to claim 4 wherein the diameter of said rotor is about eighteen inches, and the vertical distance between said effective plane of rotation and said location is less than about 5 mm.

7. A centrifuge according to claim 3 further comprising a decant ring circumferentially stationary and vertically movable with respect to said rotor in the direction of said shaft to retain said frame and processing unit in a desired orientation by engaging a portion of said processing unit.

* * * * *